US012565249B2

(12) United States Patent
Liu

(10) Patent No.: US 12,565,249 B2
(45) Date of Patent: Mar. 3, 2026

(54) SWITCH CONTROL METHOD AND APPARATUS, AND STORAGE MEDIUM

(71) Applicant: BYD COMPANY LIMITED, Shenzhen (CN)

(72) Inventor: Zhicheng Liu, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 808 days.

(21) Appl. No.: 17/956,716

(22) Filed: Sep. 29, 2022

(65) Prior Publication Data

US 2023/0031803 A1 Feb. 2, 2023

Related U.S. Application Data

(63) Continuation of application No. PCT/CN2021/083926, filed on Mar. 30, 2021.

(30) Foreign Application Priority Data

Mar. 31, 2020 (CN) ..... 202010243193.9

(51) Int. Cl.
*B61L 11/08* (2006.01)
*B61L 3/08* (2006.01)
(Continued)

(52) U.S. Cl.
CPC ..... *B61L 11/08* (2013.01); *B61L 3/08* (2013.01); *B61L 5/06* (2013.01); *B61L 5/10* (2013.01);
(Continued)

(58) Field of Classification Search
CPC ..... B61L 3/08; B61L 5/06; B61L 5/10; B61L 5/107; B61L 11/08; B61L 15/0018;
(Continued)

(56) References Cited

U.S. PATENT DOCUMENTS 5,751,569 A 5/1998 Metel et al.
2019/0144023 A1* 5/2019 Gao ..... B61L 11/08 701/19
2020/0172131 A1* 6/2020 Kernwein ..... B61L 11/08

FOREIGN PATENT DOCUMENTS

CN 106004933 A 10/2016
CN 106218673 A 12/2016
(Continued)

OTHER PUBLICATIONS

English Translation of International Search Report from PCT/CN2021/083926 dated Jun. 24, 2021 (2 pages).

*Primary Examiner* — Zachary L Kuhfuss
(74) *Attorney, Agent, or Firm* — Calfee, Halter & Griswold LLP

(57) ABSTRACT

A switch control method and apparatus, and a storage medium are provided, which relate to the field of urban rail transit technologies. The method includes: in a process that a train requests a target object for a switch resource, determining that the train is a train before and nearest a switch in combination with switch information sent from an object controller; when the switch is in an idle state, requesting the object controller to move the switch if it is determined that a current switch orientation of the switch is inconsistent with a switch orientation required by the train for the switch, so that the object controller controls to move the switch, and adjusts a status of the switch to a locked state after the switch is moved; and controlling the train to pass through the switch according to a response message returned by the object controller.

13 Claims, 5 Drawing Sheets

(51) Int. Cl.

| | |
|---|---|
| ***B61L 5/06*** | (2006.01) |
| ***B61L 5/10*** | (2006.01) |
| ***B61L 15/00*** | (2006.01) |
| ***B61L 21/04*** | (2006.01) |
| ***B61L 23/16*** | (2006.01) |
| ***B61L 27/20*** | (2022.01) |

(52) U.S. Cl.
CPC ..... *B61L 5/107* (2013.01); *B61L 15/0018* (2013.01); *B61L 15/0027* (2013.01); *B61L 21/04* (2013.01); *B61L 23/16* (2013.01); *B61L 27/20* (2022.01); *B61L 2027/204* (2022.01)

(58) Field of Classification Search
CPC ..... B61L 21/04; B61L 23/16; B61L 27/20; B61L 2027/204; B61L 15/0027
See application file for complete search history.

(56) References Cited

FOREIGN PATENT DOCUMENTS

| | | | | | |
|---|---|---|---|---|---|
| CN | 106394611 | A | | 2/2017 | |
| CN | 107054413 | A | | 8/2017 | |
| CN | 107571889 | A | | 1/2018 | |
| CN | 107914734 | A | | 4/2018 | |
| CN | 109318943 | A | | 2/2019 | |
| CN | 109677452 | A | | 4/2019 | |
| CN | 110696872 | A | | 1/2020 | |
| CN | 110696876 | A | * | 1/2020 | ..... B61L 23/00 |
| CN | 110758468 | A | | 2/2020 | |
| JP | 2009083628 | A | | 9/2007 | |

* cited by examiner

SWITCH CONTROL METHOD AND APPARATUS, AND STORAGE MEDIUM

CROSS-REFERENCE TO RELATED APPLICATIONS

The present disclosure is a bypass continuation application of PCT International Application No. PCT/CN2021/083926, filed on Mar. 30, 2021, which claims priority to and benefits of Chinese Patent Application No. 202010243193.9, entitled "SWITCH CONTROL METHOD AND APPARATUS, AND STORAGE MEDIUM", and filed on Mar. 31, 2020. The entire content of the above-referenced application is incorporated herein by reference.

FIELD

The present disclosure relates to the field of urban rail transit technologies, and in particular, to a switch control method and apparatus, and a storage medium.

BACKGROUND

In the conventional switch control method, a train usually achieves switch control by exchanging switch control information with an object controller (OC) according to switch information sent by the object controller.

SUMMARY

The present disclosure provides a switch control method and apparatus, and a storage medium, to restrict a condition that a train requests to move a switch.

According to a first aspect, the present disclosure provides a switch control method applied to a train. The method includes: receiving switch information periodically sent by an object controller, where the switch information includes a current switch state of a switch, a current switch orientation of the switch, and position information of all trains before the switch; determining whether the train is a train right before the switch according to the position information; further determining whether a current switch state of the switch is an idle state if it is learned that the train is the train right before the switch; determining, if the switch is in the idle state, whether the current switch orientation of the switch is consistent with a switch orientation required by the train for the switch; requesting the object controller to move the switch if the current switch orientation of the switch is inconsistent with the switch orientation required by the train for the switch, so that the object controller controls to move the switch, and adjusts a status of the switch to a locked state after the switch is moved; and controlling the train to pass through the switch according to a response message returned by the object controller, where the response message is used for indicating that the switch has been moved and the switch has been locked.

According to the switch control method in the embodiments of the present disclosure, in a process that a train requests a target object for a switch resource, that the train is a train before and nearest a switch is determined in combination with switch information sent from an object controller; when the switch is in an idle state, the object controller is requested to move the switch if it is determined that a current switch orientation of the switch is inconsistent with a switch orientation required by the train for the switch, so that the object controller controls to move the switch, and adjusts a status of the switch to a locked state after the switch is moved; and the train is controlled to pass through the switch according to a response message returned by the object controller. Therefore, in the process that the train requests the target object for the switch resource, a condition that the train requests to move the switch is restricted, and then it is determined that the train is the train right before the switch in combination with the switch information provided by the object controller.

According to a second aspect, the present disclosure provides a switch control method applied to an object controller. The method includes: receiving a moving request of a first train for a switch; determining whether the first train is the train right before the switch; further determining whether the switch is in an idle state if the first train is the train right before the switch; moving the switch according to the moving request if the switch is in the idle state; and adjusting a status of the switch to a locked state after it is detected that the switch is moved, and returning a response message to the first train, so that the first train passes through the switch, where the response message is used for indicating that the switch has been moved and the switch has been locked.

According to the switch control method in the embodiments of the present disclosure, in a process that a train requests a target object for a switch resource, that the train is a train before and nearest a switch is determined in combination with switch information sent from an object controller; when the switch is in an idle state, the object controller is requested to move the switch if it is determined that a current switch orientation of the switch is inconsistent with a switch orientation required by the train for the switch, so that the object controller controls to move the switch, and adjusts a status of the switch to a locked state after the switch is moved; and the train is controlled to pass through the switch according to a response message returned by the object controller. Therefore, in the process that the train requests the target object for the switch resource, a condition that the train requests to move the switch is restricted, and then it is determined that the train is the train right before the switch in combination with the switch information provided by the object controller.

According to a third aspect, the present disclosure provides a switch control apparatus applied to a train. The apparatus includes: a receiving module, configured to receive switch information periodically sent by an object controller, where the switch information includes a current switch state of a switch, a current switch orientation of the switch, and position information of all trains before the switch; a first determining module, configured to determine whether the train is a train right before the switch according to the position information; a second determining module, configured to further determine whether the current switch state of the switch is an idle state if it is learned that the train is the train right before the switch; a third determining module, configured to determine, if the switch is in the idle state, whether the current switch orientation of the switch is consistent with a switch orientation required by the train for the switch; a requesting module, configured to request the object controller to move the switch if the current switch orientation of the switch is inconsistent with the switch orientation required by the train for the switch, so that the object controller controls to move the switch, and adjust a status of the switch to a locked state after the switch is moved; and a first control module, configured to control the train to pass through the switch according to a response message returned by the object controller, where the response message is used for indicating that the switch has been moved and the switch has been locked.

According to the switch control apparatus in the embodiments of the present disclosure, in a process that a train requests a target object for a switch resource, that the train is a train before and nearest a switch is determined in combination with switch information sent from an object controller; when the switch is in an idle state, the object controller is requested to move the switch if it is determined that a current switch orientation of the switch is inconsistent with a switch orientation required by the train for the switch, so that the object controller controls to move the switch, and adjusts a status of the switch to a locked state after the switch is moved; and the train is controlled to pass through the switch according to a response message returned by the object controller. Therefore, in the process that the train requests the target object for the switch resource, a condition that the train requests to move the switch is restricted, and then it is determined that the train is the train right before the switch in combination with the switch information provided by the object controller.

According to a fourth aspect, the present disclosure provides a switch control apparatus applied to an object controller. The apparatus includes: a first receiving module, configured to receive a moving request of a first train for a switch; a first determining module, configured to determine whether the first train is the train right before the switch; a second determining module, configured to further determine whether the switch is in an idle state if the first train is the train right before the switch; a moving module, configured to move the switch according to the moving request if the switch is in the idle state; and a control module, configured to adjust a status of the switch to a locked state after it is detected that the switch is moved, and return a response message to the first train, so that the first train passes through the switch, where the response message is used for indicating that the switch has been moved and the switch has been locked.

According to the switch control apparatus in the embodiments of the present disclosure, after the moving request of the first train for the switch is received, it is determined that the first train is the train right before the switch in combination with a situation of the train right before the switch and a current switch state of the switch. When it is determined that the switch is in the idle state, the first train is agreed to move the switch. After it is detected that the switch is moved, the status of the switch is adjusted to the locked state, and a response message is returned to the first train, so that the first train passes through the switch. Therefore, in a process that the object controller manages a switch resource of the train, the object controller restricts a condition that the train requests to move the switch, and it is determined that the switch is in the idle state in combination with the switch state of the switch.

According to a fifth aspect, the present disclosure provides a computer-readable storage medium, storing a computer program. The computer program, when executed by a processor, implements the switch control method in the embodiments according to the first aspect, or the switch control method in the embodiments according to the second aspect.

Additional aspects and advantages of the present disclosure are partially given in the following description, and partially become apparent in the following description or may be learned through the practice of the present disclosure.

BRIEF DESCRIPTION OF THE DRAWINGS

The above and/or additional aspects and advantages of the present disclosure will become evident and easy to understand through embodiments described with reference with drawings outlined below.

DETAILED DESCRIPTION

Figure 1:
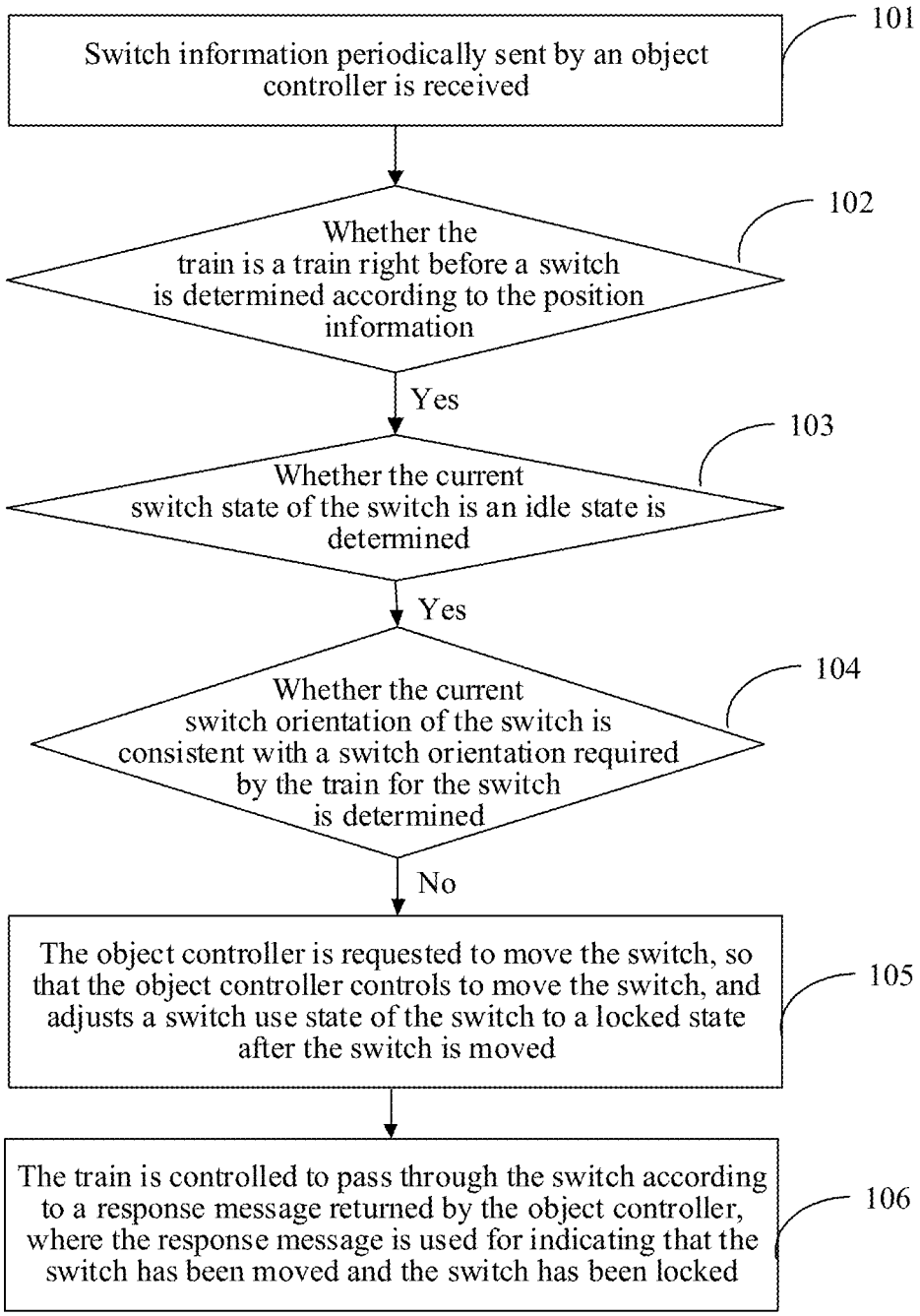
FIG. 1 is a flowchart of a switch control method according to an embodiment of the present disclosure.

Embodiments of the present disclosure are described in detail below, and examples of the embodiments are shown in accompanying drawings, where the same or similar elements or the elements having same or similar functions are denoted by the same or similar reference numerals throughout the description. The embodiments described below with reference to the accompanying drawings are exemplary and used only for explaining the present disclosure, and should not be construed as a limitation on the present disclosure.

The switch control method and apparatus, and storage medium in the embodiments of the present disclosure are described below with reference to the accompanying drawings.

One of the disadvantages of some conventional switch control methods may result in the following situation: When two trains right before a switch both request to operate the switch, the latter train operates the switch first while the front train cannot operate the switch, which may easily result in safety accidents.

Some embodiments of the present subject matter prevent a train that is not the train right before the switch from moving the switch, improving a safety protection capability, and improving running safety of the train FIG. 1 is a flowchart of a switch control method according to an embodiment of the present disclosure. It should be noted that, an execution body of the switch control method in this embodiment is a switch control apparatus. The switch control apparatus may be configured in an in-vehicle device, and the in-vehicle device may be configured in a train.

As shown in FIG. 1, the switch control method may include the following steps.

Step 101. Switch information periodically sent by an object controller is received.

The switch information includes a current switch state of a switch, a current switch orientation of the switch, and position information of all trains before the switch.

The object controller in this embodiment manages all railway resources on a railway.

A switch orientation of the switch includes a normal position and a reverse position.

The current switch state of the switch includes an idle state, a locked state, a commandeered state, and a faulty state.

Figure 2:
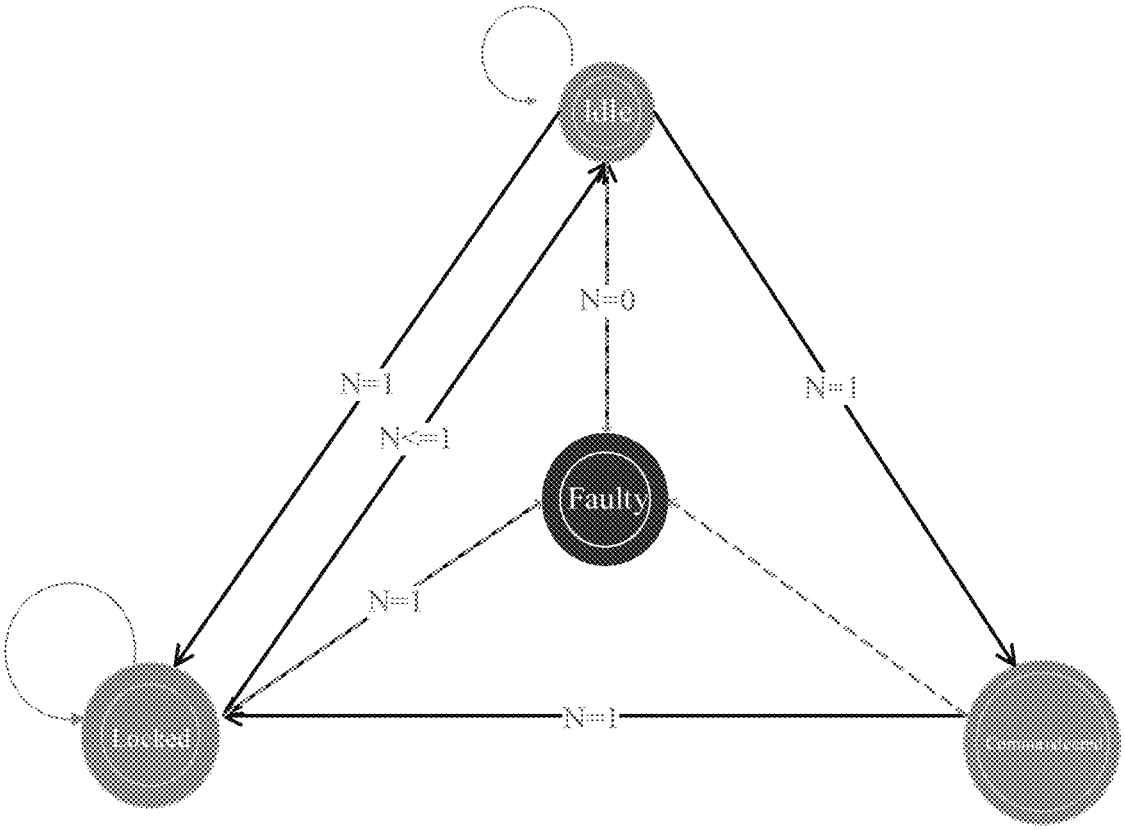
FIG. 2 is an example diagram of a relationship between a switch state of a switch and the number of users.

An example of a relationship between a switch state of the switch and the number of users is shown in FIG. 2. N represents the number of users, and the number of users in this embodiment is the number of trains using the switch.

The switch control method in this embodiment is applicable to a vehicle based train control (VBTC) system. The system does not require a trackside device such as trackside ZC, CI, axle counter, or signal machine, thereby reducing device costs and maintenance costs.

It should be understood that the switch in this embodiment is connected to the OC, is directly controlled by the OC, and is not connected to an interlocking device such as axle counter, which can simplify control logic, and reduce the device costs and maintenance costs.

Step 102. Whether the train is a train before and nearest a switch is determined according to the position information. If yes, step 103 is performed.

In this embodiment, because the position information includes position information of all trains before the switch, whether the train is the train right before the switch can be accurately determined based on a current position of each train and a position of the switch.

Step 103. Whether the current switch state of the switch is an idle state is determined. If yes, step 104 is performed.

In this embodiment, when the switch control apparatus determines that the train is the train right before the switch, and determines that the current switch state of the switch is not the idle state, the switch control apparatus controls the train not to perform any operation on the switch, and continues to monitor the switch information periodically sent by the object controller until it is determined that the train is the train right before the switch according to received switch information. When the switch is in the idle state, step 104 is performed.

Step 104. Whether the current switch orientation of the switch is consistent with a switch orientation required by the train for the switch is determined. If inconsistent, step 105 is performed.

In this embodiment, if it is determined that the current switch orientation of the switch is consistent with the switch orientation required by the train for the switch, because the train is the train right before the switch and the switch is in the idle state, it indicates that no other trains are using the switch at this moment. At this time, the switch control apparatus can directly request a corresponding controller for commandeering and locking the switch. Correspondingly, after receiving an authorization instruction returned by the object controller for the request, the switch control apparatus can control the train to run through the switch.

Step 105. The object controller is requested to move the switch, so that the object controller controls to move the switch, and adjusts a status of the switch to a locked state after the switch is moved.

Step 106. The train is controlled to pass through the switch according to a response message returned by the object controller, where the response message is used for indicating that the switch has been moved and the switch has been locked.

In this embodiment, it is determined that the switch is in the idle state in combination with the switch information obtained from the object controller, specifically in combination with the switch state of the switch and the position information of all trains before the switch. When the train is the train right before the switch, it is determined that the train meets a condition for sending a request for moving the switch to the object controller. When it is determined that the current switch orientation of the switch is inconsistent with the switch orientation required by the train for the switch, the train is controlled to request to move the switch. Therefore, in a switch control process, ground devices such as an interlocking machine, a signal machine, and an axle counter in the conventional interlocking technology are not required, thereby simplifying control logic, and reducing device costs and maintenance costs. In addition, the train can actively request for a switch resource as required, which improves the rail transit efficiency, and verifies whether the train has an authority to operate the switch in the process that the train actively requests for the switch resource. Therefore, a situation that a train that is not the train right before the switch first requests to operate the switch, causing the train right before the switch to fail to use the switch is avoided, thereby improving a safety protection capability of a system and improving running safety of the train.

According to the switch control method in the embodiments of the present disclosure, in a process that a train requests a target object for a switch resource, that the train is a train before and nearest a switch is determined in combination with switch information sent from an object controller; when the switch is in an idle state, the object controller is requested to move the switch if it is determined that a current switch orientation of the switch is inconsistent with a switch orientation required by the train for the switch, so that the object controller controls to move the switch, and adjusts a status of the switch to a locked state after the switch is moved; and the train is controlled to pass through the switch according to a response message returned by the object controller. Therefore, in the process that the train requests the target object for the switch resource, a condition that the train requests to move the switch is restricted, and then it is determined that the train is the train right before the switch in combination with the switch information provided by the object controller. When the switch is in the idle state, according to a moving operation of the train for the switch, a situation that a train that is not the train right before the switch first requests to operate the switch, causing the train right before the switch to fail to use the switch is avoided, thereby improving a safety protection capability and improving running safety of the train.

Figure 3:
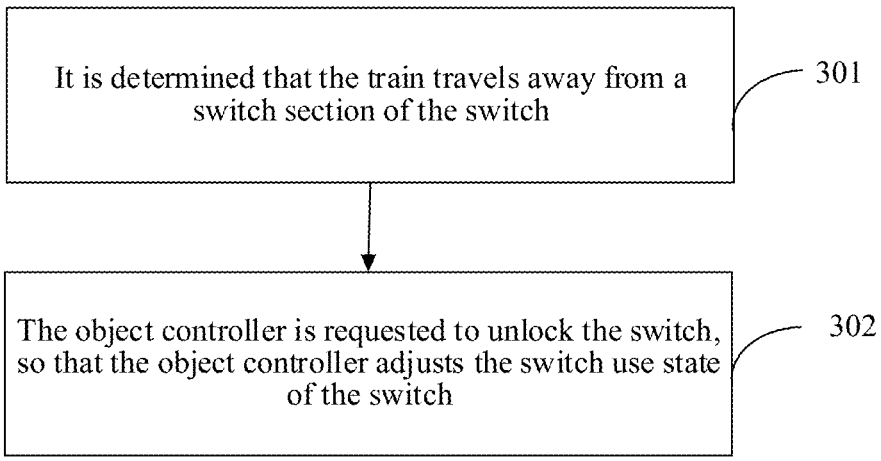
FIG. 3 is a flowchart of a switch control method according to another embodiment of the present disclosure.

Based on the above implementations, in order to enable another train right before the switch to continue using the switch after the train has used the switch resource, the train needs to be controlled to release the switch resource in time. In an embodiment of the present disclosure, based on the embodiment shown in FIG. 1, as shown in FIG. 3, after step 106, the method may further include:

Step 301. It is determined that the train travels away from a switch section of the switch.

Wherein, the switch section includes a switch protection section.

Wherein, in order to ensure safety, two logic sections before and after the switch need to be locked simultaneously. A length of the logic section is relatively short, and a plurality of logic sections may be required to form a protection section for the switch section. The length includes at least a length of an intrusion section.

Step 302. The object controller is requested to unlock the switch, so that the object controller adjusts the status of the switch.

After the switch is locked, the train can be controlled to run through the switch and whether the train occupies a switch region where the switch is cleared is detected. If it is detected that the train occupies the switch region where the switch is cleared, it indicates that the train travels away from the switch section of the switch. At this time, the object controller can be requested to unlock the switch, so that the object controller adjusts the status of the switch.

Correspondingly, after the object controller receives a switch unlocking request sent by the train, the object controller can further determine whether the train travels away from the switch section of the switch. After it is determined that the train travels away from the switch section of the switch, record related to the train in a switch state record table of the switch can be deleted. Whether there is another train locking switch is determined according to a current switch state record table. If there is another train locking switch, the switch is controlled to continue to remain in the locked state. If it is determined that there is no another train locking switch, the switch state of the switch is adjusted to the idle state.

In this embodiment, the switch control apparatus in the train determines whether the train meets a condition of requesting unlock, and when it is determined that the train meets the unlocking condition, requests the object controller to unlock the switch. Correspondingly, the object controller further determines whether the train meets the unlocking condition after receiving the unlocking request for the switch, and releases locking of the switch by the train after determining that the train meets the unlocking condition. Therefore, the unlocking of the switch by the train is bilaterally managed by the train and the object controller, which further improves the safety protection capability of the system.

Figure 4:
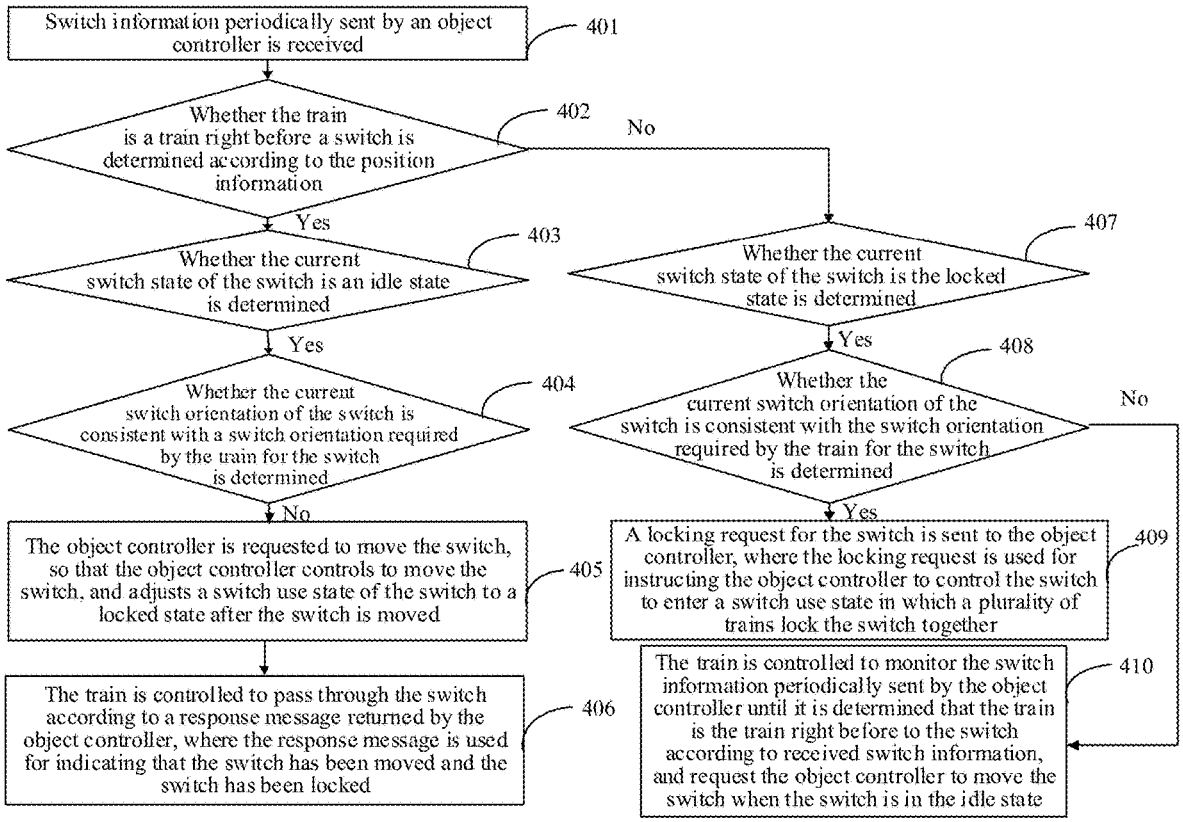
FIG. 4 is a flowchart of a switch control method according to another embodiment of the present disclosure.

FIG. 4 is a flowchart of a switch control method according to another embodiment of the present disclosure. It should be noted that, this embodiment provides a further detailed or optimized description of the embodiment shown in FIG. 1.

As shown in FIG. 4, the switch control method may include the following steps.

Step 401. Switch information periodically sent by an object controller is received.

Step 402. Whether the train is a train before and nearest a switch is determined according to the position information. If yes, step 403 is performed, otherwise, step 407 is performed.

Step 403. Whether the current switch state of the switch is an idle state is determined. If yes, step 404 is performed.

Step 404. Whether the current switch orientation of the switch is consistent with a switch orientation required by the train for the switch is determined. If inconsistent, step 405 is performed.

In this embodiment, after it is determined that the train is the train right before the switch and the switch is in the idle state, the train may request to commandeer the switch, request to move the switch to a preset position required by the train, lock the switch, and then control the train to pass through the switch.

Correspondingly, after the object controller receives the request of the train for commandeering the switch, whether the train is the train right before the switch can be determined, and whether the switch is in the idle state can be determined. When it is determined that the train is the train right before the switch and the switch is in the idle state, it is determined that the train has successfully requested to commandeer the switch, and a message that the request to commandeer the switch is successful is fed back to the train. Therefore, the safety protection capability of the system is further improved.

Figure 5:
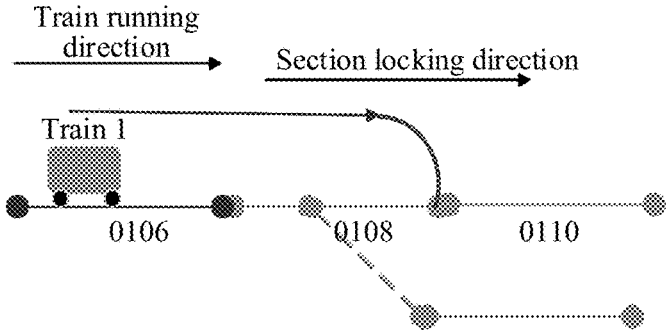
FIG. 5 is an example diagram that a train is the train before and nearest a switch and the switch is in an idle state.

The train is the train right before the switch, and the switch is in the idle state, as shown in FIG. 5.

In order to make a person skilled in the related art more clearly understand the present disclosure, the switch control method in this embodiment is described by using an application scenario shown in FIG. 5 as an example. Specifically, the train right before the switch in FIG. 5 needs to use the switch resource during a passing process. At this time, an in-vehicle device in the train can receive switch information of the switch sent by the object controller, and determine that the train is the train right before the switch according to position information of the train right before the switch in the switch information. At this time, the in-vehicle device can continue to determine whether the switch is in the idle state or not. If it is determined that the switch is in the idle state, it is determined that the train can request to move the switch. When the in-vehicle device determines that a current switch orientation of the switch is inconsistent with a switch orientation required by the train for the switch, the in-vehicle device requests the object controller to move the switch. Correspondingly, the object controller determines that the train is the train right before the switch, and when the switch is in the idle state, determines that the switch has an authority to move the switch. According to a moving request of the train, the switch is moved, and after the switch is moved, that the switch is locked by the train is recorded in a switch state record table of the object controller. Correspondingly, response information is fed back to the in-vehicle device, so that the in-vehicle device passes through the switch according to the response information. When the train passes through the switch, the in-vehicle device requests the object controller to unlock the switch, to release the switch resource in time, facilitate subsequent use of the switch by the train that needs to continue using the switch, and achieve sharing of the railway resource.

Step 405. The object controller is requested to move the switch, so that the object controller controls to move the switch, and adjusts a status of the switch to a locked state after the switch is moved.

Step 406. The train is controlled to pass through the switch according to a response message returned by the object controller, where the response message is used for indicating that the switch has been moved and the switch has been locked.

Step 407. Whether the current switch state of the switch is the locked state. If yes, step 408 is performed.

In this embodiment, after it is determined that the train is not the train right before the switch, and the switch state of the switch is not the locked state, in order to prevent a relevant operation performed by the train from affecting the train right before the switch, the train may be controlled to continue to monitor the switch information periodically sent by the object controller, until it is determined that the train is not the train right before the switch and the switch is in the locked state according to received switch information, and then step 408 is performed.

Step 408. Whether the current switch orientation of the switch is consistent with the switch orientation required by the train for the switch is determined. If yes, step 409 is performed, otherwise, step 410 is performed.

Step 409. A locking request for the switch is sent to the object controller, where the locking request is used for instructing the object controller to control the switch to enter a status in which a plurality of trains lock the switch together.

That is, in this embodiment, if the train right before the switch has locked the switch, and the train is completely consistent with the switch orientation required by the train right before the switch, the train can directly send the switch locking request to the object controller, so that the object controller controls a plurality of trains to lock the switch, and records the locked state in in the switch state record table, where the locked state corresponds to the plurality of trains. That is, if the former train has locked the switch and switch orientations (normal position or reverse position) required by the former train and this train are completely consistent, this train can directly request to lock the switch, to share the use right of the switch with the former car, thereby improving the rail transit efficiency.

The switch state record table in this embodiment is shown in Table 1.

| | | |
|---|---|---|
| Switch number | ID | |
| Switch direction | Up/Down | |
| Switch orientation | Normal position/reverse position | |
| Status | Commandeered | Train number: Train 2 |
| | Locked (or single locked) | Train number table: Train 1, Train 2, Train 3 . . . |
| | Idle | |
| | Faulty | |

Figure 6:
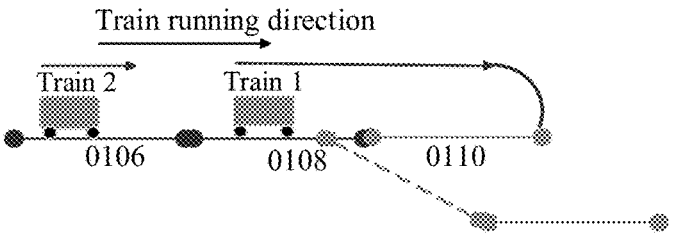
FIG. 6 is an example diagram of two trains in the same direction and on the same rail.

An example diagram of two trains in the same direction and on the same rail is shown in FIG. 6.

In order to make a person skilled in the related art more clearly understand the present disclosure, the switch control method in this embodiment is further described below with reference to FIG. 6. For convenience of description, it is assumed that the train before and nearest the switch is a train A, the train behind train A is a train B, the in-vehicle device in the train A is an in-vehicle device A, and the in-vehicle device in the train B is an in-vehicle device B.

Correspondingly, a specific process of the switch control method in this embodiment is: Both the in-vehicle device A and the in-vehicle device B receive switch information of a forward switch periodically sent by the object controller. It is assumed that the switch information includes: A current switch state of the switch is an idle state, and a switch orientation of the switch is a reverse position. Correspondingly, the in-vehicle device A can determine that the train A is the train right before the switch according to the switch information, and determine that the switch state of the switch is the idle state. At this time, if the in-vehicle device A determines that the switch orientation of the switch does not meet a switch orientation (normal position) required by the train A for the switch, the in-vehicle device A can request the object controller to move the switch. Correspondingly, after the object controller receives the moving request of the in-vehicle device A for the switch, the object controller determines that the train A corresponding to the in-vehicle device A is indeed the train right before the switch, and the switch is in the idle state. At this time, the object controller controls to move the switch. After the switch is moved, a status of the switch in the switch state record table of the object controller is modified to the locked state, and the switch is locked by the train A. It can be understood that, because the switch orientation of the switch has been moved by the train A, at this time, the current switch orientation of the switch changes to the normal position. Correspondingly, the object controller adjusts the switch orientation of the switch to the normal position in the switch state record table of the switch.

It can be understood that, in a process that the in-vehicle device A performs the switch control method, the in-vehicle device B also performs the switch control method. The in-vehicle device B determines that the train B is not the train right before the switch, and the switch is in the idle state. At this time, the in-vehicle device B continues to monitor the switch information of the switch periodically sent by the object controller. When it is detected that the switch state of the switch is the locked state, the in-vehicle device B continues to determine whether the current switch orientation of the switch is the normal position, and whether the current switch orientation is consistent with the switch orientation (normal position) required by the train B for the switch. If consistent, the in-vehicle device B can request the object controller to lock the switch. Correspondingly, the object controller controls, according to the locking request of the in-vehicle device B, to enter a state in which a plurality of trains lock the switch together. At this time, the train A and the train B share the use right of this switch.

Correspondingly, after determining that the train A travels away from the switch section of the switch, the in-vehicle device A requests the object controller to release the locking f or the switch by the train A. Correspondingly, when determining that the train A indeed travels away from a switch region of the switch, the object controller deletes the record about the train A in the switch state record table. At this time, because the train B also locks the switch, the switch state of the switch continues to be the locked state, but the train B becomes the train right before the switch.

Correspondingly, when the in-vehicle device B determines that the train B is the train right before the switch according to the switch information of the switch periodically sent by the object controller, and the switch is in the locked state, because switch orientations required by the train A and the train B for the switch are consistent, at this time, the in-vehicle device B can control the train B to pass through the switch. After the train B passes through the switch section of the switch, the in-vehicle device B requests the object controller to unlock the switch.

In this embodiment, when switch orientations of former and latter trains right before the switch for the switch are consistent, after the former train locks the switch, the latter train can directly request the object controller to lock the switch, to share a use right of the switch with the former train, thereby improving the rail transit efficiency.

Step 410. The train is controlled to monitor the switch information periodically sent by the object controller until it is determined that the train is the train right before the switch according to received switch information, and request the object controller to move the switch when the switch is in the idle state.

That is, the former train has locked and used the switch. The switch orientations required by the train and the former train are inconsistent. The train needs to use a start point of the switch section as an MA danger point to protect, and cannot request for the use right of the switch. After the former train releases the locking for the switch, and the switch turns into the idle state, the switch is requested to move.

Figure 7:
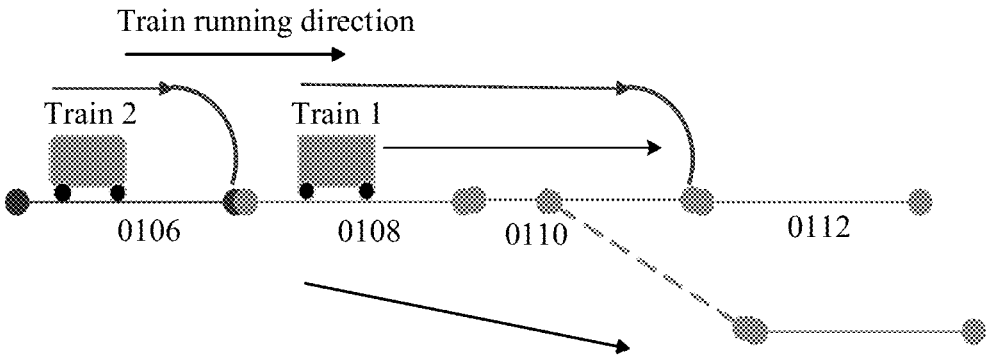
FIG. 7 is an example diagram of two trains in the same direction and on different rails.

An example diagram of two trains in the same direction and on different rails is shown in FIG. 7. It can be seen from FIG. 7 that switch orientations required by the two trains on the rail for the switch are different. For convenience of description, it is assumed that, in FIG. 7, the train before and nearest the switch is a train A, the train behind the train A is a train B, the in-vehicle device in the train A is an in-vehicle device A, and the in-vehicle device in the train B is an in-vehicle device B. It is assumed that the train A takes the route above the switch, and the train B takes the route below the switch.

The switch control method in this embodiment is described below with reference to FIG. 7. The switch control method is as follows:

After the train A has locked and used the switch, the in-vehicle device B in the train B determines that the switch orientation of the switch is inconsistent with the switch orientation of the train B according to the switch information sent by the object controller in this cycle. Because the train A is using the switch, the in-vehicle device B does not request the object controller to move the switch, and continues to monitor the switch information periodically sent by the object controller. When it is detected that it is determined that the train B is the train right before the switch according to currently received switch information, and it is determined that the switch is in the idle state, the in-vehicle device B requests the object controller to move the switch. That is, after the train A releases the locking for the switch, and the switch turns into the idle state, the train B requests to move the switch. Therefore, in the process that the train requests the target object for the switch resource, a condition that the train requests to move the switch is restricted, and then it is determined that the train is the train right before the switch in combination with the switch information provided by the object controller. When the switch is in the idle state, according to a moving operation of the train for the switch, a situation that a train that is not the train right before the switch first requests to operate the switch, causing the train right before the switch to fail to use the switch is avoided, thereby improving a safety protection capability and improving running safety of the train.

In this embodiment, it can be understood that the train in this embodiment is an AT train, that is, a train with a communication function. In a process that the train passes through the switch and travels away from the switch section of the switch, sometimes the train is faulty, causing the train to fail to communicate with the object controller. Usually, when the train is faulty, the train is controlled by an ATS system, to plan the route of the train through the ATS system. In order to release the locking for the switch by the train in time, in an embodiment of the present disclosure, before the object controller is requested to unlock the switch, whether the train is downgraded to an unequipped train (UT) can also be determined. If the train is not downgraded to the UT train, the switch control apparatus can directly request the object controller to unlock the switch.

That is, if the train is in a fault state, and cannot establish a communication connection with the object controller, the switch control apparatus may send a control request to the object controller through the ATS system. The control request is used for instructing the object controller to release the locking for the switch by the train.

The route refers to a path at which the train travels.

The AT train refers to a communication train, which has a communication function and can feed back position information and the like to the object controller in real time.

The UT train refers to an unequipped train.

In addition, it can be understood that, the object controller in this embodiment can communicate not only with the switch control apparatus in the train, but also with the ATS system, and can perform corresponding operations according to a control request of the ATS system.

In an embodiment of the present disclosure, in order to avoid an authority conflict when the train and the ATS system control the object controller simultaneously, in this embodiment, a priority level of the ATS system can be set higher than that of the train. That is, both the train and a dispatch center can issue a command to the OC to control the switch, and the dispatch center has priority over the train in terms of a priority of using the switch. Therefore, the authority conflict can be avoided and the safety protection capability can be further improved.

Figure 8:
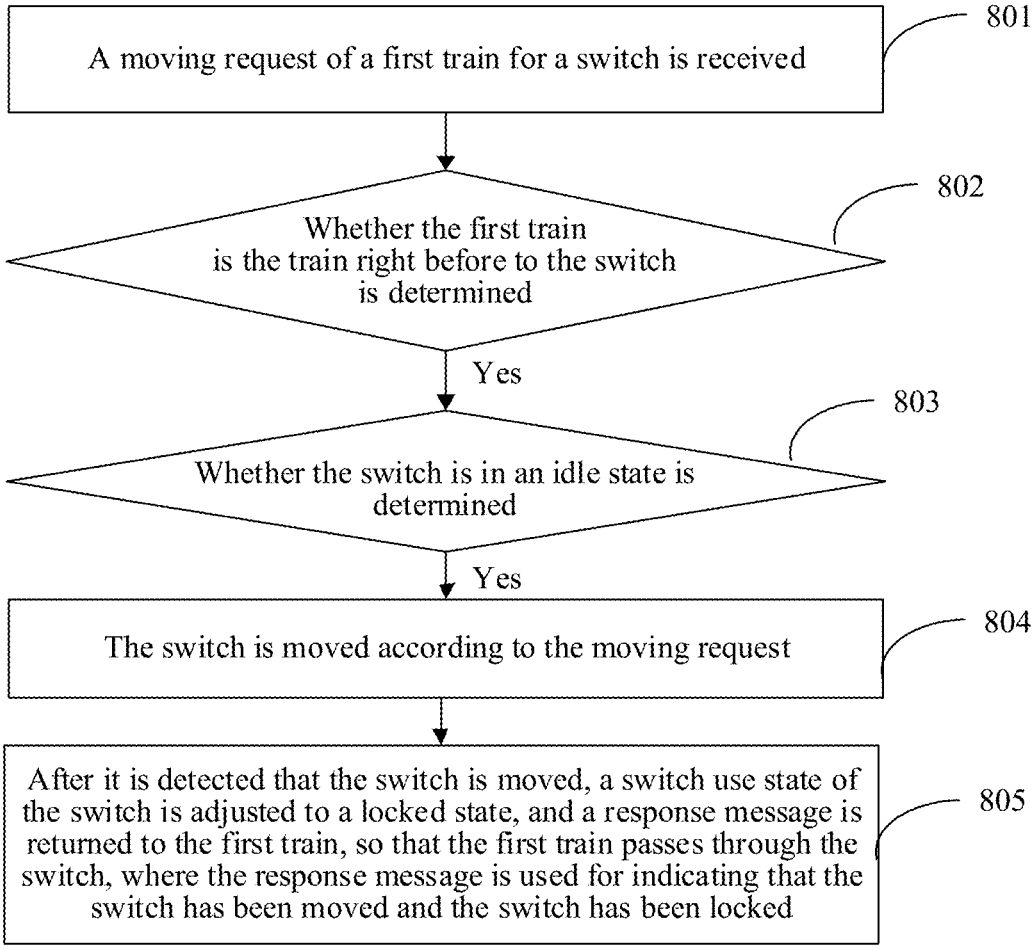
FIG. 8 is a flowchart of a switch control method according to another embodiment of the present disclosure.

FIG. 8 is a flowchart of a switch control method according to another embodiment of the present disclosure. It should be noted that, an execution body of the switch control method in this embodiment is a switch control apparatus. The switch control apparatus may be configured in an object controller. This embodiment is described by using an example in which the execution body of the switch control method is the object controller.

As shown in FIG. 8, the switch control method may include the following steps.

Step 801. A moving request of a first train for a switch is received.

Step 802. Whether the first train is the train right before the switch is determined. If yes, step 803 is performed.

It can be understood that the object controller in this embodiment is a manager of all railway resources. Correspondingly, the first train in this embodiment reports its own position information to the object controller in real time.

The object controller can determine whether the first train is the train right before the switch based on position information of each train right before the switch.

In this embodiment, if the first train is not the train right before the switch, it is determined that the first train does not have an authority to move the switch. At this time, the moving request of the first train for the switch is directly rejected.

Step 803. Whether the switch is in an idle state is determined. If yes, step 804 is performed.

Step 804. The switch is moved according to the moving request.

Step 805. After it is detected that the switch is moved, a status of the switch is adjusted to a locked state, and a response message is returned to the first train, so that the first train passes through the switch, where the response message is used for indicating that the switch has been moved and the switch has been locked.

For example, a train A sends a request of moving the switch to the object controller. After the object controller receives the request of the train A, the object controller may determine whether the switch is in the idle state. If the switch is in the idle state, whether the train A is the train right before the switch is further determined. If the train A is the train right before the switch, a moving authority of the switch is authorized to the train A. That is, the train A is agreed to perform a moving operation on the switch.

According to the switch control method in the embodiments of the present disclosure, after the moving request of the first train for the switch is received, it is determined that the first train is the train right before the switch in combination with a situation of the train right before the switch and a current switch state of the switch. When it is determined that the switch is in the idle state, the first train is agreed to move the switch. After it is detected that the switch is moved, the status of the switch is adjusted to the locked state, and a response message is returned to the first train, so that the first train passes through the switch. Therefore, in a process that the object controller manages a switch resource of the train, the object controller restricts a condition that the train requests to move the switch, and it is determined that the switch is in the idle state in combination with the switch state of the switch. When it is determined that the requesting train is the first train of the switch, it is determined that the train has an authority to move the switch. According to a moving operation of the train for the switch, a situation that a train that is not the train right before the switch first requests to operate the switch, causing the train right before the switch to fail to use the switch is avoided, thereby improving a safety protection capability and improving running safety of the train.

Based on the foregoing embodiments, in order to release the switch resource in time and facilitate the subsequent first train to use the switch resource, in an embodiment of the present disclosure, after the response message is returned to the first train, the method may include: receiving an unlocking request of the first train for the switch, releasing the locking for the switch by the first train and adjusting the status of the switch according to the unlocking request.

Specifically, after the object controller receives the unlocking request of the first train for the switch, the object controller determines that the first train occupies a switch section where the switch is cleared. That is, after the object controller determines that the first train travels away from the switch section of the switch, the object controller can delete a relevant record of the first train in the switch state record table, and determine whether another train locks the switch currently after the relevant record of the first train is deleted. If not, the switch state of the switch is adjusted to the idle state.

Based on the foregoing embodiments, the object controller in this embodiment may further receive a control request sent by the ATS system. The control request is used for instructing the object controller to release the locking for the switch by the first train. The control request is sent by the ATS system after it is determined that the first train is downgraded to a UT train.

In an embodiment of the present disclosure, after the response message is returned to the first train, so that the first train passes through the switch, the method may further include: receiving a locking request of a second train for the switch; determining whether a current switch state of the switch is the locked state; and controlling, if the current switch state of the switch is the locked state, the switch to enter a status in which a plurality of trains lock the switch together.

In an embodiment of the present disclosure, when the switch is faulty, the object controller may also communicate with the ATS system, so that the ATS system blocks the section and arranges manual processing.

After the switch returns to normal, the object controller can detect a train occupancy state, and then adjust the switch state of the switch according to the train occupancy state. If there is a train waiting to use the switch, the switch is directly turned into a locked switch of the train, so that the corresponding train continues to use the switch, thereby improving the rail transit efficiency. If there is no train, the switch state of the switch is adjusted to the idle state.

Based on the foregoing embodiments, for a switch in a turn-back region, the switch is locked and used by one train and cannot be shared. Therefore, in an embodiment of the present disclosure, after receiving the locking request of the second train for the switch, the object controller may further determine whether the switch is in the turn-back region. If the switch is in the turn-back region, the locking request of the train for the switch is directly rejected.

In addition, based on the above description of this embodiment, it can be seen that ground devices such as an interlocking machine, a signal machine, and an axle counter in the conventional interlocking technology are not required in this embodiment, thereby simplifying control logic, and reducing device costs and maintenance costs. Meanwhile, the in-vehicle device actively requests for the switch resource as required, which improves the rail transit efficiency, and the in-vehicle VOBC and the OC bilaterally calibrate a device use authority, which improves the safety protection capability of the system.

Figure 9:
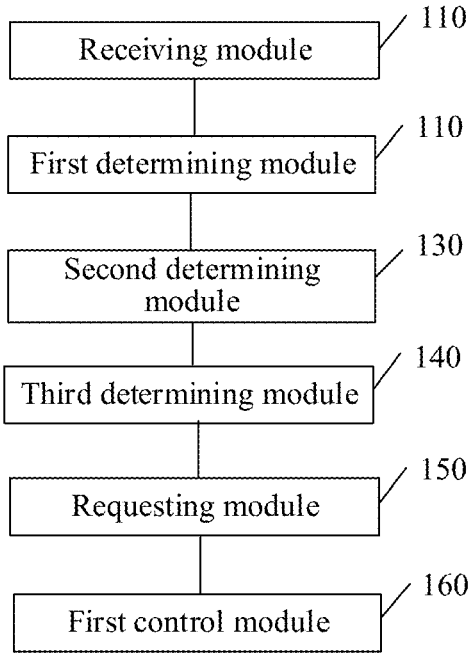
FIG. 9 is a schematic structural diagram of a switch control apparatus according to an embodiment of the present disclosure.

FIG. 9 is a schematic structural diagram of a switch control apparatus according to an embodiment of the present disclosure. It should be noted that, the switch control apparatus may be configured in an in-vehicle device. The in-vehicle device may be configured in a train.

As shown in FIG. 9, the switch control apparatus may include a receiving module 110, a first determining module 120, a second determining module 130, a third determining module 140, a requesting module 150, and a first control module 160.

The receiving module 110 is configured to receive switch information periodically sent by an object controller, where the switch information includes a current switch state of a switch, a current switch orientation of the switch, and position information of all trains before the switch.

The first determining module 120 is configured to determine whether the train is a train right before the switch according to the position information.

The second determining module 130 is configured to further determine whether the current switch state of the switch is an idle state if it is learned that the train is the train right before the switch.

The third determining module 140 is configured to determine, if the switch is in the idle state, whether the current switch orientation of the switch is consistent with a switch orientation required by the train for the switch.

The requesting module 150 is configured to request the object controller to move the switch if the current switch orientation of the switch is inconsistent with the switch orientation required by the train for the switch, so that the object controller controls to move the switch, and adjusts a status of the switch to a locked state after the switch is moved.

The first control module 160 is configured to control the train to pass through the switch according to a response message returned by the object controller, where the response message is used for indicating that the switch has been moved and the switch has been locked.

In an embodiment of the present disclosure, the apparatus further includes:

a determining module, configured to determine that the train travels away from a switch section of the switch; and an unlocking module, configured to request the object controller to unlock the switch, so that the object controller unlocks the switch and adjusts the status of the switch.

In another embodiment of the present disclosure, the apparatus further includes:

a fourth determining module, configured to further determine whether the current switch state of the switch is the locked state if it is learned that the train is not the train right before the switch;

a fifth determining module, configured to determine, if the current switch state of the switch is the locked state, whether the current switch orientation of the switch is consistent with the switch orientation required by the train for the switch; and a locking requesting module, configured to send a locking request for the switch to the object controller if the current switch orientation of the switch is consistent with the switch orientation required by the train for the switch, where the locking request is used for instructing the object controller to control the switch to enter a status in which a plurality of trains lock the switch together.

In another embodiment of the present disclosure, the apparatus further includes:

a sixth determining module, configured to determine whether the train is downgraded to a UT train; and an unlocking requesting module, configured to request the object controller to unlock the switch when the train is not downgraded to the UT train.

In another embodiment of the present disclosure, the apparatus further includes:

a processing module, configured to send a control request to the object controller through an automatic train supervision (ATS) system if the train is downgraded to the UT train, where the control request is used for instructing the object controller to release the locking for the switch by the train.

In another embodiment of the present disclosure, the apparatus further includes:

a second control module, configured to, after the fifth determining module determines that the current switch state of the switch is the locked state and determines whether the current switch orientation of the switch is consistent with the switch orientation required by the train for the switch, if the current switch orientation of the switch is inconsistent with the switch orientation required by the train for the switch, control the train to monitor the switch information periodically sent by the object controller until it is determined that the train is the train right before the switch according to received switch information, and request the object controller to move the switch when the switch is in the idle state.

It should be noted that, the foregoing illustrations and descriptions of the switch control method according to the embodiment in the first aspect are also applicable to this embodiment, and will not be repeated herein.

According to the switch control apparatus in this embodiment, in a process that a train requests a target object for a switch resource, that the train is a train before and nearest a switch is determined in combination with switch information sent from an object controller; when the switch is in an idle state, the object controller is requested to move the switch if it is determined that a current switch orientation of the switch is inconsistent with a switch orientation required by the train for the switch, so that the object controller controls to move the switch, and adjusts a status of the switch to a locked state after the switch is moved; and the train is controlled to pass through the switch according to a response message returned by the object controller. Therefore, in the process that the train requests the target object for the switch resource, a condition that the train requests to move the switch is restricted, and then it is determined that the train is the train right before the switch in combination with the switch information provided by the object controller. When the switch is in the idle state, according to a moving operation of the train for the switch, a situation that a train that is not the train right before the switch first requests to operate the switch, causing the train right before the switch to fail to use the switch is avoided, thereby improving a safety protection capability and improving running safety of the train.

In order to implement the foregoing embodiments, the present disclosure further provides a train. The train includes the switch control apparatus in the foregoing embodiment.

In order to implement the foregoing embodiments, the present disclosure further provides a switch control apparatus.

Figure 10:
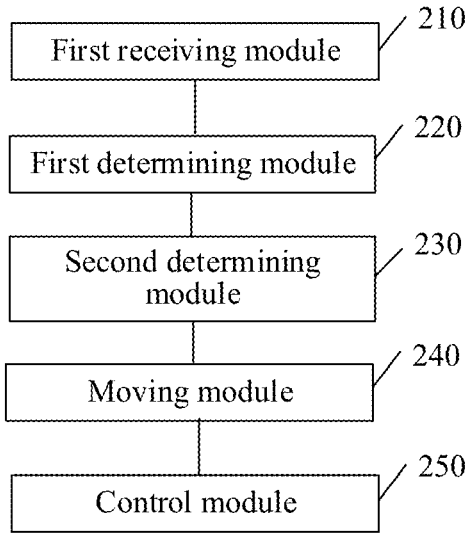
FIG. 10 is a schematic structural diagram of a switch control apparatus according to another embodiment of the present disclosure.

FIG. 10 is a schematic structural diagram of a switch control apparatus according to another embodiment of the present disclosure. It should be noted that, the switch control apparatus may be configured in an object controller.

As shown in FIG. 10, the switch control apparatus may include:

a first receiving module 210, configured to receive a moving request of a first train for a switch;

a first determining module 220, configured to determine whether the first train is the train right before the switch;

a second determining module 230, configured to further determine whether the switch is in an idle state if the first train is the train right before the switch;

a moving module 240, configured to move the switch according to the moving request if the switch is in the idle state; and a control module 250, configured to adjust a status of the switch to a locked state after it is detected that the switch is moved, and return a response message to the first train, so that the first train passes through the switch, where the response message is used for indicating that the switch has been moved and the switch has been locked.

In another embodiment of the present disclosure, the apparatus further includes:

a second receiving module, configured to receive an unlocking request of the first train for the switch; and an unlocking module, configured to release the locking for the switch by the first train and adjust the status of the switch according to the unlocking request.

In another embodiment of the present disclosure, the apparatus further includes:

a third receiving module, configured to receive a locking request of a second train for the switch;

a third determining module, configured to determine whether a current switch state of the switch is the locked state; and a control module, further configured to control, if the current switch state of the switch is the locked state, the switch to enter a status in which a plurality of trains lock the switch together.

It should be noted that, the foregoing illustrations and descriptions of the method embodiments are also applicable to the apparatus embodiments, and will not be repeated herein.

According to the switch control apparatus in the embodiments of the present disclosure, after the moving request of the first train for the switch is received, it is determined that the first train is the train right before the switch in combination with a situation of the train right before the switch and a current switch state of the switch. When it is determined that the switch is in the idle state, the first train is agreed to move the switch. After it is detected that the switch is moved, the status of the switch is adjusted to the locked state, and a response message is returned to the first train, so that the first train passes through the switch. Therefore, in a process that the object controller manages a switch resource of the train, the object controller restricts a condition that the train requests to move the switch, and it is determined that the switch is in the idle state in combination with the switch state of the switch. When it is determined that the requesting train is the first train of the switch, it is determined that the train has an authority to move the switch. According to a moving operation of the train for the switch, a situation that a train that is not the train right before the switch first requests to operate the switch, causing the train right before the switch to fail to use the switch is avoided, thereby improving a safety protection capability and improving running safety of the train.

In order to implement the foregoing embodiments, the present disclosure further provides a computer-readable storage medium, storing a computer program. The computer program, when executed by a processor, implements the switch control method according to any one of the foregoing embodiments of the present disclosure.

In the description of the present disclosure, it should be understood that, unless otherwise specifically limited, "plurality of" means at least two, for example, two or three. In the present disclosure, unless otherwise explicitly specified or defined, the terms such as "mount", "connect", "connection", and "fix" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two elements or mutual action relationship between two elements, unless otherwise specified explicitly. A person of ordinary skill in the related art may understand the specific meanings of the foregoing terms in the present disclosure according to specific situations.

In the descriptions of this specification, descriptions of a reference term such as "an embodiment", "some embodiments", "an example", "a specific example", or "some examples" means that a specific feature, structure, material, or characteristic that is described with reference to the embodiment or the example is included in at least one embodiment or example of the present disclosure. In the present specification, schematic representations of the above terms are not necessarily directed to the same embodiments or examples. Besides, the specific feature, the structure, the material, or the characteristic that is described may be combined in proper manners in any one or more embodiments or examples. In addition, a person skilled in the related art may integrate or combine different embodiments or examples described in the specification and features of the different embodiments or examples as long as they are not contradictory to each other.

Any process or method in the flowcharts or described herein in another manner may be understood as indicating a module, a segment, or a part including code of one or more executable instructions for implementing a particular logical function or process step. In addition, the scope of preferred implementations of the present disclosure includes other implementations which do not follow the order shown or discussed, including performing, according to involved functions, the functions basically simultaneously or in a reverse order, which should be understood by a person skilled in the related art to which the embodiments of the present disclosure belong.

The logic and/or steps shown in the flowcharts or described in any other manner herein, for example, a sequenced list that may be considered as executable instructions used for implementing logical functions, may be specifically implemented in any computer readable medium to be used by an instruction execution system, apparatus, or device (for example, a computer-based system, a system including a processor, or another system that can obtain an instruction from the instruction execution system, apparatus, or device and execute the instruction) or to be used by combining such instruction execution systems, apparatuses, or devices. In the context of this specification, a "computer-readable medium" may be any apparatus that can include, store, communicate, propagate, or transmit the program for use by the instruction execution system, apparatus, or device or in combination with the instruction execution system, apparatus, or device. More specific examples (a non-exhaustive list) of the computer-readable medium include the following: an electrical connection (electronic device) having one or more wires, a portable computer diskette (magnetic apparatus), a random access memory (RAM), a read-only memory (ROM), an erasable programmable read-only memory (EPROM or flash memory), an optical fiber apparatus, and a portable compact disk read-only memory (CDROM). In addition, the computer-readable medium can even be paper or other suitable media on which the program can be printed, because the program can be obtained electronically by, for example, optically scanning paper or other media, then editing, interpreting, or processing in other suitable ways if necessary, and then storing it in a computer memory.

It should be understood that, each part of the present disclosure can be implemented by hardware, software, firmware or a combination thereof. In the foregoing implementations, a plurality of steps or methods may be implemented by using software or firmware that are stored in a memory and are executed by a proper instruction execution system. For example, if being implemented by hardware, like another implementation, the plurality of steps or methods may be implemented by any one of following common technologies in the related art or a combination thereof: a discrete logic circuit of a logic gate circuit for realizing a logic function for a data signal, an application specific integrated circuit having a suitable combined logic gate circuit, a programmable gate array (PGA), and a field programmable gate array (FPGA).

A person of ordinary skill in the related art may understand that all or some of the steps of the methods in the foregoing embodiments may be implemented by a program instructing relevant hardware. The program may be stored in a computer-readable storage medium. When the program is executed, one or a combination of the steps of the method embodiments are performed.

In addition, functional units in the embodiments of the present disclosure may be integrated into one processing module, or each of the units may exist alone physically, or two or more units may be integrated into one module. The integrated module is implemented in the form of hardware, or is implemented in the form of a software functional module. If implemented in the form of software functional modules and sold or used as an independent product, the integrated module may also be stored in a computer-readable storage medium.

The storage medium mentioned above may be a read-only memory, a magnetic disk, an optical disc, or the like. Although the embodiments of the present disclosure have been shown and described above, it can be understood that, the foregoing embodiments are exemplary and should not be understood as limitation to the present disclosure. A person of ordinary skill in the related art can make changes, modifications, replacements, or variations to the foregoing embodiments within the scope of the present disclosure.

What is claimed is:

1. A switch control method, applied to a train, the method comprising:

receiving switch information periodically sent by an object controller, wherein the switch information comprises a current switch state of a switch, a current switch orientation of the switch, and position information of all trains before the switch;

determining whether the train is a train right before the switch according to the position information;

further determining whether the current switch state of the switch is an idle state if it is learned that the train is the train right before the switch;

determining, if the switch is in the idle state, whether the current switch orientation of the switch is consistent with a switch orientation required by the train for the switch;

requesting the object controller to move the switch if the current switch orientation of the switch is inconsistent with the switch orientation required by the train for the switch, so that the object controller controls to move the switch, and adjusts a status of the switch to a locked state after the switch is moved; and controlling the train to pass through the switch according to a response message returned by the object controller, wherein the response message is configured to indicate that the switch has been moved and the switch has been locked, the method further comprising:

further determining whether the current switch state of the switch is the locked state if it is learned that the train is not the train right before the switch;

determining, if the current switch state of the switch is the locked state, whether the current switch orientation of the switch is consistent with the switch orientation required by the train for the switch; and sending a locking request for the switch to the object controller if the current switch orientation of the switch is consistent with the switch orientation required by the train for the switch, wherein the locking request is configured to instruct the object controller to control the switch to enter a status in which a plurality of trains lock the switch together.

2. The method according to claim 1, wherein after the controlling the train to pass through the switch according to a response message returned by the object controller, the method further comprises:

determining that the train travels away from a switch section of the switch; and requesting the object controller to unlock the switch, so that the object controller unlocks the switch and adjusts the status of the switch.

3. The method according to claim 2, wherein before the requesting the object controller to unlock the switch, the method further comprises:

determining whether the train is downgraded to a UT train; and performing the step of requesting the object controller to unlock the switch if the train is not downgraded to the UT train.

4. The method according to claim 3, further comprising:

sending a control request to the object controller through an automatic train supervision (ATS) system if the train is downgraded to the UT train, wherein the control request is configured to instruct the object controller to release the locking for the switch by the train.

5. The method according to claim 4, wherein after the determining, if the current switch state of the switch is the locked state, whether the current switch orientation of the switch is consistent with the switch orientation required by the train for the switch, the method further comprises:

controlling, if the current switch orientation of the switch is inconsistent with the switch orientation required by the train for the switch, the train to monitor the switch information periodically sent by the object controller until it is determined that the train is the train right before the switch according to received switch information, and requesting the object controller to move the switch when the switch is in the idle state.

6. The method according to claim 3, wherein after the determining, if the current switch state of the switch is the locked state, whether the current switch orientation of the switch is consistent with the switch orientation required by the train for the switch, the method further comprises:

controlling, if the current switch orientation of the switch is inconsistent with the switch orientation required by the train for the switch, the train to monitor the switch information periodically sent by the object controller until it is determined that the train is the train right before the switch according to received switch information, and requesting the object controller to move the switch when the switch is in the idle state.

7. The method according to claim 1, wherein after the determining, if the current switch state of the switch is the locked state, whether the current switch orientation of the switch is consistent with the switch orientation required by the train for the switch, the method further comprises:

controlling, if the current switch orientation of the switch is inconsistent with the switch orientation required by the train for the switch, the train to monitor the switch information periodically sent by the object controller until it is determined that the train is the train right before the switch according to received switch information, and requesting the object controller to move the switch when the switch is in the idle state.

8. A switch control method, applied to an object controller, the method comprising:

receiving a moving request of a first train for a switch;

determining whether the first train is a train right before the switch;

further determining whether the switch is in an idle state if the first train is the train right before the switch;

moving the switch according to the moving request if the switch is in the idle state; and adjusting a status of the switch to a locked state after it is detected that the switch is moved, and returning a response message to the first train, so that the first train passes through the switch, wherein the response message is configured to indicate that the switch has been moved and the switch has been locked, wherein after the returning a response message to the first train, the method further comprises:

receiving a locking request of a second train for the switch;

determining whether a current switch state of the switch is the locked state; and controlling, if the current switch state of the switch is the locked state, the switch to enter a status in which a plurality of trains lock the switch together.

9. The method according to claim 8, wherein after the returning a response message to the first train, the method further comprises:

receiving an unlocking request of the first train for the switch, releasing the locking for the switch by the first train and adjusting the status of the switch according to the unlocking request.

10. The method according to claim 9, wherein after the returning a response message to the first train, the method further comprises:

receiving a locking request of a second train for the switch;

determining whether a current switch state of the switch is the locked state; and controlling, if the current switch state of the switch is the locked state, the switch to enter a status in which a plurality of trains lock the switch together.

11. A switch control apparatus, applied to a train, the apparatus comprising:

a receiving module, configured to receive switch information periodically sent by an object controller, wherein the switch information comprises a current switch state of a switch, a current switch orientation of the switch, and position information of all trains before the switch;

a first determining module, configured to determine whether the train is a train right before the switch according to the position information;

a second determining module, configured to further determine whether the current switch state of the switch is an idle state if it is learned that the train is the train right before the switch;

a third determining module, configured to determine, if the switch is in the idle state, whether the current switch orientation of the switch is consistent with a switch orientation required by the train for the switch;

a requesting module, configured to request the object controller to move the switch if the current switch orientation of the switch is inconsistent with the switch orientation required by the train for the switch, so that the object controller controls to move the switch, and adjusts a status of the switch to a locked state after the switch is moved; and a first control module, configured to control the train to pass through the switch according to a response message returned by the object controller, wherein the response message is configured to indicate that the switch has been moved and the switch has been locked, the apparatus further comprising:

a fourth determining module, configured to further determine whether the current switch state of the switch is the locked state if it is learned that the train is not the train right before the switch;

a fifth determining module, configured to determine, if the current switch state of the switch is the locked state, whether the current switch orientation of the switch is consistent with the switch orientation required by the train for the switch; and a first sending module, configured to send a locking request for the switch to the object controller if the current switch orientation of the switch is consistent with the switch orientation required by the train for the switch, wherein the locking request is configured to instruct the object controller to control the switch to enter a status in which a plurality of trains lock the switch together.

12. A switch control apparatus, applied to an object controller, the apparatus comprising:

a first receiving module, configured to receive a moving request of a first train for a switch;

a first determining module, configured to determine whether the first train is the train right before the switch;

a second determining module, configured to further determine whether the switch is in an idle state if the first train is the train right before the switch;

a moving module, configured to move the switch according to the moving request if the switch is in the idle state; and a first control module, configured to adjust a status of the switch to a locked state after it is detected that the switch is moved, and return a response message to the first train, so that the first train passes through the switch, wherein the response message is configured to indicate that the switch has been moved and the switch has been locked, wherein after the returning a response message to the first train, the apparatus further comprises:

a second receiving module, configured to receive a locking request of a second train for the switch;

a third determining module, configured to determine whether a current switch state of the switch is the locked state; and a second control module, configured to control, if the current switch state of the switch is the locked state, the switch to enter a status in which a plurality of trains lock the switch together.

13. A non-transitory computer-readable storage medium, storing a computer program, the computer program, when executed by a processor, implementing a switch control method, applied to a train, the method comprising:

receiving switch information periodically sent by an object controller, wherein the switch information comprises a current switch state of a switch, a current switch orientation of the switch, and position information of all trains before the switch;

determining whether the train is a train right before the switch according to the position information;

further determining whether the current switch state of the switch is an idle state if it is learned that the train is the train right before the switch;

determining, if the switch is in the idle state, whether the current switch orientation of the switch is consistent with a switch orientation required by the train for the switch;

requesting the object controller to move the switch if the current switch orientation of the switch is inconsistent with the switch orientation required by the train for the switch, so that the object controller controls to move the switch, and adjusts a status of the switch to a locked state after the switch is moved; and controlling the train to pass through the switch according to a response message returned by the object controller, wherein the response message is configured to indicate that the switch has been moved and the switch has been locked, the method further comprising:

further determining whether the current switch state of the switch is the locked state if it is learned that the train is not the train right before the switch;

determining, if the current switch state of the switch is the locked state, whether the current switch orientation of the switch is consistent with the switch orientation required by the train for the switch; and sending a locking request for the switch to the object controller if the current switch orientation of the switch is consistent with the switch orientation required by the train for the switch, wherein the locking request is configured to instruct the object controller to control the switch to enter a status in which a plurality of trains lock the switch together.

* * * * *